US007878163B2

(12) United States Patent
Kim et al.

(10) Patent No.: US 7,878,163 B2
(45) Date of Patent: Feb. 1, 2011

(54) VARIABLE VALVE LIFT APPARATUS

(75) Inventors: Hyung Ick Kim, Gunpo (KR); Wootae Kim, Suwon (KR); Ingee Suh, Yongin (KR); Dong Hee Han, Seoul (KR); Back Sik Kim, Osan (KR); Dae Sung Kim, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 493 days.

(21) Appl. No.: 11/950,729

(22) Filed: Dec. 5, 2007

(65) Prior Publication Data

US 2009/0025667 A1 Jan. 29, 2009

(30) Foreign Application Priority Data

Jul. 24, 2007 (KR) ..... 10-2007-0074114

(51) Int. Cl.
*F01L 1/34* (2006.01)

(52) U.S. Cl. ..... 123/90.16; 123/90.39; 123/90.44; 123/90.45; 74/569

(58) Field of Classification Search ..... 123/90.12, 123/90.39, 90.44, 90.16, 90.45, 90.46; 74/559, 74/567, 569
See application file for complete search history.

(56) References Cited

U.S. PATENT DOCUMENTS 4,883,027 A * 11/1989 Oikawa et al. ..... 123/90.16

FOREIGN PATENT DOCUMENTS

JP 04284111 A * 10/1992
JP 05-033613 A 2/1993

* cited by examiner

*Primary Examiner*—Ching Chang
(74) *Attorney, Agent, or Firm*—Morgan, Lewis & Bockius LLP

(57) ABSTRACT

A variable valve lift apparatus includes an end lever; a variable lift body connected to the end lever, and rotatable around the end lever, a valve mounted on the variable lift body; and a low lift cam operable to open and close the valve. The variable lift body includes a high lift body, and a low lift body rotatable around the high lift body. A low lift connecting portion selectively connects the low lift body and the high lift body.

15 Claims, 6 Drawing Sheets

VARIABLE VALVE LIFT APPARATUS

CROSS-REFERENCE TO RELATED APPLICATION

This application claims priority to, and the benefit of, Korean Patent Application No. 10-2007-0074114, filed in the Korean Intellectual Property Office on Jul. 24, 2007, the entire contents of which are incorporated herein by reference.

BACKGROUND OF THE INVENTION (a) Field of the Invention

The present invention relates to a variable valve lift apparatus that adjusts a valve lift amount in response to an operational state of an engine.

(b) Description of the Related Art

A typical combustion chamber of an automotive engine is provided with an intake valve for supplying the air/fuel mixture and an exhaust valve for expelling the burned gas. The intake and exhaust valves are opened and closed by a valve lift apparatus connected to a crankshaft.

A conventional valve lift apparatus has a fixed valve lift amount due to a fixed cam shape. Therefore, it is impossible to adjust the amount of a gas that is being introduced or exhausted.

If the valve lift apparatus is designed for low driving speeds, the valve open time and amount are not sufficient for high speeds. On the other hand, if the valve lift apparatus is designed for high speeds, the opposite is true.

The above information disclosed in this Background section is only for enhancement of understanding of the background of the invention and therefore it may contain information that does not form the prior art that is already known in this country to a person of ordinary skill in the art.

SUMMARY OF THE INVENTION

A variable valve lift apparatus includes an end lever; a variable lift body connected to the end lever, and rotatable around the end lever, a valve mounted on the variable lift body; and a low lift cam operable to open and close the valve. The variable lift body includes a high lift body, and a low lift body rotatable around the high lift body. A low lift connecting portion selectively connects the low lift body and the high lift body.

The low lift connecting portion may include a hydraulic line; a low lift pin connecting portion disposed on the low lift body; a hydraulic pressure adjusting valve disposed on the end lever for selectively supplying hydraulic pressure to the hydraulic line; and a low lift pin selectively connected to the low lift pin connecting portion, for connecting the low lift body and the high lift body when hydraulic pressure is supplied thereto from the hydraulic line.

The low lift connecting portion may also include a low lift pin inserting portion in the low lift body in fluid communication with the hydraulic line, with the low lift pin disposed therein; and a low lift pin elastic member disposed in the low lift pin inserting portion and supplying a restoring force to the low lift pin.

The hydraulic line may include a first hydraulic line in the end lever, connected to the hydraulic pressure adjusting valve; a second hydraulic line in the end lever, connected to the first hydraulic line; and a third hydraulic line in the low lift body, connected with the second hydraulic line and the low lift pin inserting portion.

The apparatus may further include a high lift cam for opening and closing the valve, a high lift head that reciprocates according to rotation of the high lift cam, a high lift head supporting portion for supporting the high lift head, a high lift elastic member supplying a restoring force to the high lift head, and a high lift connecting portion for selectively connecting the high lift supporting portion and the high lift body.

The high lift connecting portion may include an actuator disposed on the end lever, a high lift shaft that is disposed in the end lever and is selectively rotated by the actuator, a high lift pin connecting portion in the high lift head supporting portion, and a high lift pin selectively connected to the high lift pin connecting portion by rotation of the high lift shaft.

The high lift shaft may have a cross-section defined by a substantially circular arc and a substantially linear portion.

The high lift connecting portion may also include a high lift pin inserting portion with the high lift pin disposed therein, and a high lift elastic member disposed in the high lift pin inserting portion for supplying a restoring force to the high lift pin.

The apparatus may further include a high lift assisting pin disposed between the high lift shaft and the high lift pin.

The high lift connecting portion may include a high lift hydraulic pressure adjusting valve disposed on the end lever, a high lift hydraulic line in fluid communication with the high lift hydraulic pressure adjusting valve, a high lift pin inserting portion disposed in the high lift body and in fluid communication with the high lift hydraulic line, and a high lift pin disposed in the high lift pin inserting portion and selectively connecting the high lift head supporting portion and the high lift body.

The high lift connecting portion may further include a high lift pin elastic member disposed in the high lift pin inserting portion and supplying a restoring force to the high lift pin.

The lift amount of the low lift cam and the lift amount of the high lift cam may be different.

A lost motion elastic portion may be provided for supporting and supplying a restoring force to the low lift body.

A needle bearing may be provided such that the low lift body reciprocates according to rotation of the low lift cam.

BRIEF DESCRIPTION OF THE DRAWINGS

FIG. 2 (*b*) is an enlarged view of a portion of FIG. 1, showing a low lift pin inserting portion in an off state of the hydraulic pressure adjusting valve.

FIG. 3 (*b*) is an enlarged view of a portion of FIG. 1, showing a low lift pin inserting portion in an on state of the hydraulic pressure adjusting valve.

DESCRIPTION OF REFERENCE NUMERALS INDICATING PRIMARY ELEMENTS IN THE DRAWINGS

| | |
|---|---|
| 100 | end lever |
| 110 | hydraulic pressure adjusting valve |
| 115 | first hydraulic line |
| 117 | second hydraulic line |
| 120 | actuator |
| 130 | high lift shaft |
| 140 | high lift hydraulic pressure adjusting valve |
| 150 | fourth hydraulic line |
| 200 | low lift body |
| 201 | variable lift body |
| 210 | low lift body connecting pin |
| 220 | needle bearing |
| 230 | low lift pin connecting portion |
| 240 | low lift pin inserting portion |
| 250 | low lift pin |
| 260 | low lift pin elastic member |
| 270 | third hydraulic line |
| 280 | lost motion elastic portion |
| 300 | high lift body |
| 310 | high lift head |
| 320 | high lift head supporting portion |
| 325 | high lift pin connecting portion |
| 330 | high lift elastic member |
| 340 | high lift body inserting portion |
| 350 | high lift pin |
| 360 | high lift pin inserting portion |
| 370 | high lift pin elastic member |
| 380 | high lift assisting pin |
| 390 | notch |
| 400 | low lift cam |
| 410 | high lift cam |
| 450 | valve |
| 510 | high lift head |
| 520 | high lift head supporting portion |
| 530 | high lift elastic member |
| 540 | high lift body inserting portion |
| 550 | high lift pin |
| 560 | high lift pin inserting portion |
| 570 | high lift pin elastic member |
| 590 | fifth hydraulic line |

DETAILED DESCRIPTION OF PREFERRED EMBODIMENTS

Figure 1:
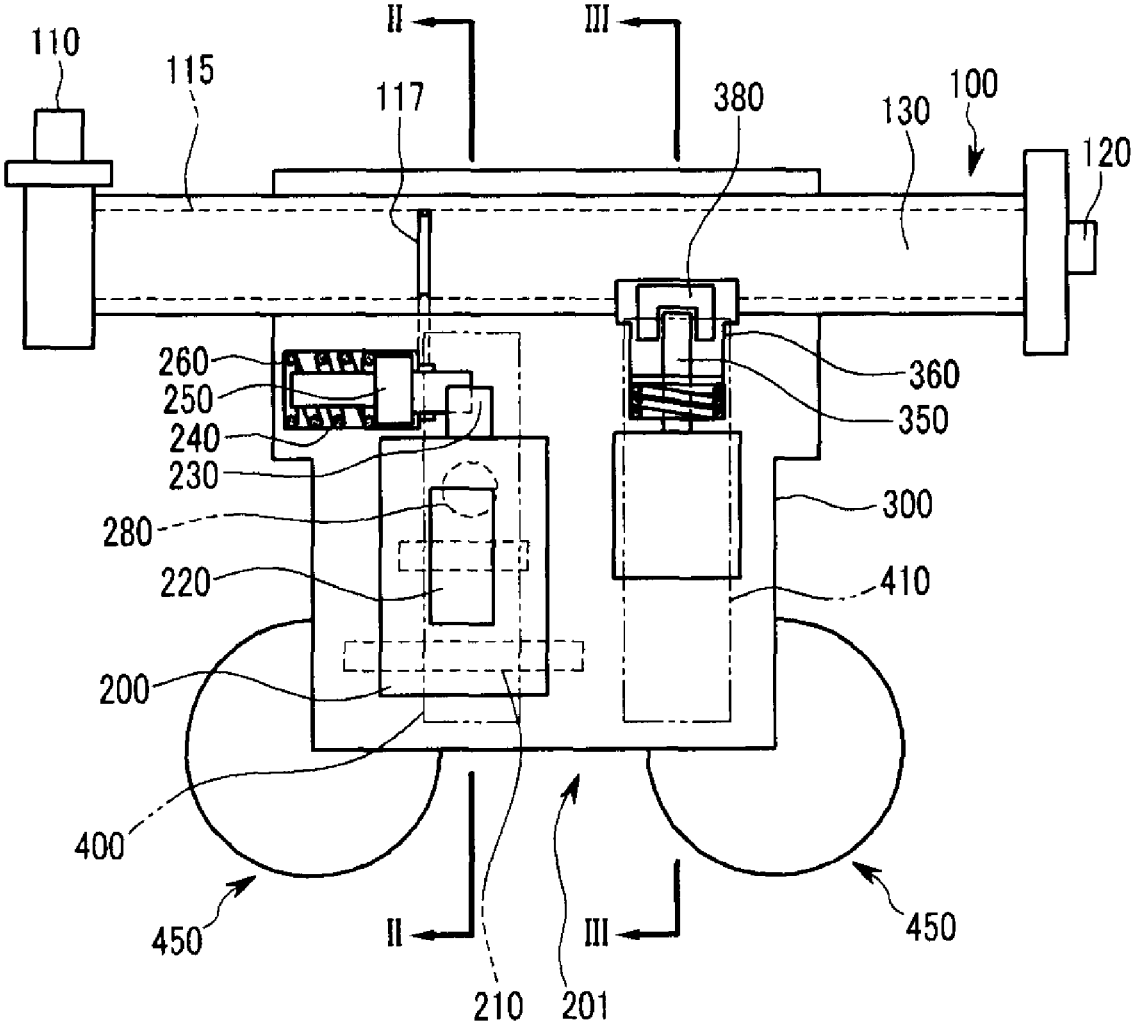
FIG. 1 is a schematic illustration of a variable valve lift apparatus according to an exemplary embodiment of the present invention.

Exemplary embodiments of the present invention will hereinafter be described in detail with reference to the accompanying drawings As shown in FIG. 1, a variable valve lift according to an exemplary embodiment of the present invention includes an end lever 100 and a variable lift body 201 that is connected with the end lever 100 and can rotate around the end lever 100.

A valve 450 is mounted to the variable lift body 201.

The variable lift body 201 includes a high lift body 300 and a low lift body 200 that is connected with the high lift body 300 by a low lift body connecting pin 210. The low lift body 200 can rotate around the low lift body connecting pin 210.

A hydraulic pressure adjusting valve 110 is provided to the end lever 100 and selectively supplies hydraulic pressure to the apparatus.

The hydraulic pressure adjusting valve 110 is controlled by an electronic control unit (ECU, not shown), which may include a processor, memory, and associated hardware, software, and/or firmware as may be selected and programmed by a person of ordinary skill in the art based on the teachings herein.

The hydraulic pressure adjusting valve 110 is connected with a hydraulic line, and the hydraulic line includes a first hydraulic line 115 that is formed in the end lever 100 and connected to the hydraulic pressure adjusting valve 110, a second hydraulic line 117 that is formed in the end lever 100 and connected to the first hydraulic line 115, and a third hydraulic line 270 (FIG. 2) that is formed in the low lift body 200 and connected to the second hydraulic line 117.

A low lift pin inserting portion 240 is formed in the low lift body 200 for receiving hydraulic pressure from the third hydraulic line 270.

A low lift pin 250 is disposed in the low lift pin inserting portion 240 and a low lift pin elastic member 260 is provided to supply a restoring force to the low lift pin 250.

A low lift pin connecting portion 230 is provided to the low lift body 200.

Figure 2:
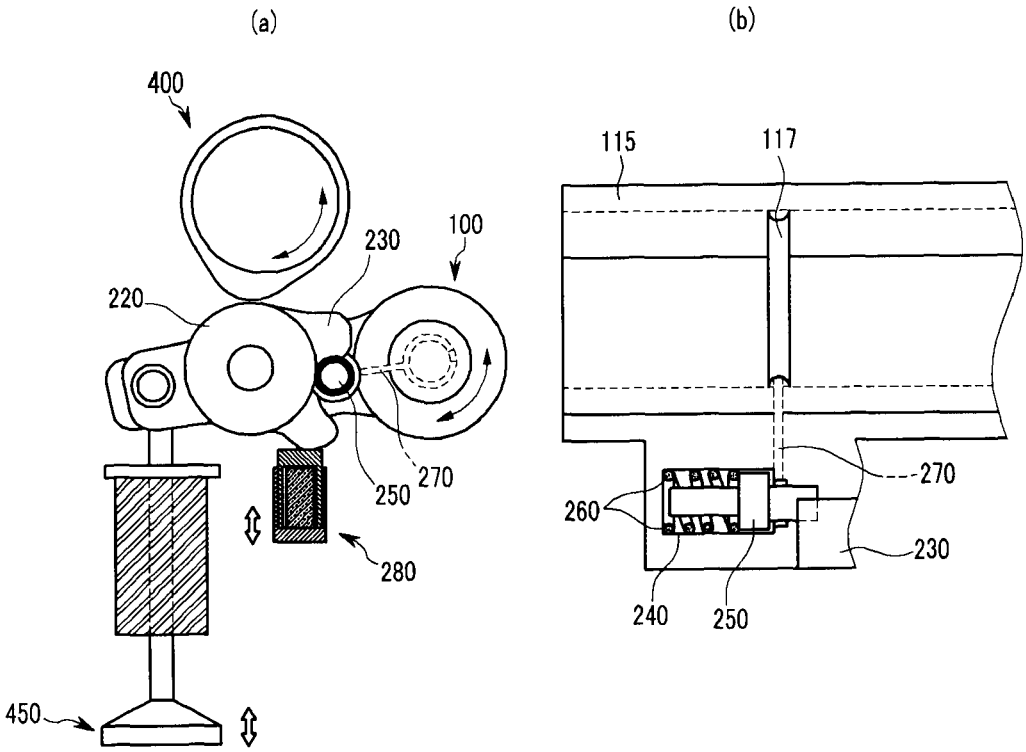
FIG. 2 (*a*) is a cross-sectional view taken along line II-II of FIG. 1, showing an off state of a hydraulic pressure adjusting valve.
Figure 3:
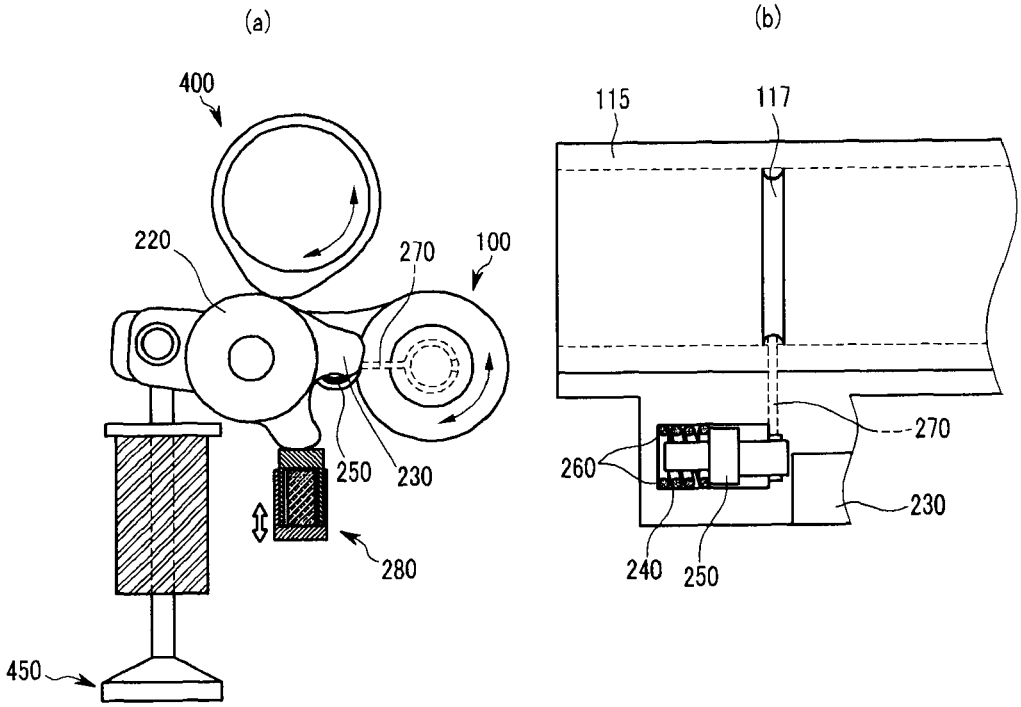
FIG. 3 (*a*) is a cross-sectional view taken along line II-II of FIG. 1, showing an on state of a hydraulic pressure adjusting valve.

FIG. 2 and FIG. 3 are cross-sectional views taken along line II-II of FIG. 1, showing an off state and an on state, respectively, of the hydraulic pressure adjusting valve 110.

As shown in FIG. 2 (*a*) and FIG. 3 (*a*), a low lift cam 400 is provided, and a bearing 220 transfers the rotation of the low lift cam 400.

A lost motion elastic portion 280 is disposed below the low lift body 200 for supplying a restoring force to the low lift body 200.

Figure 4:
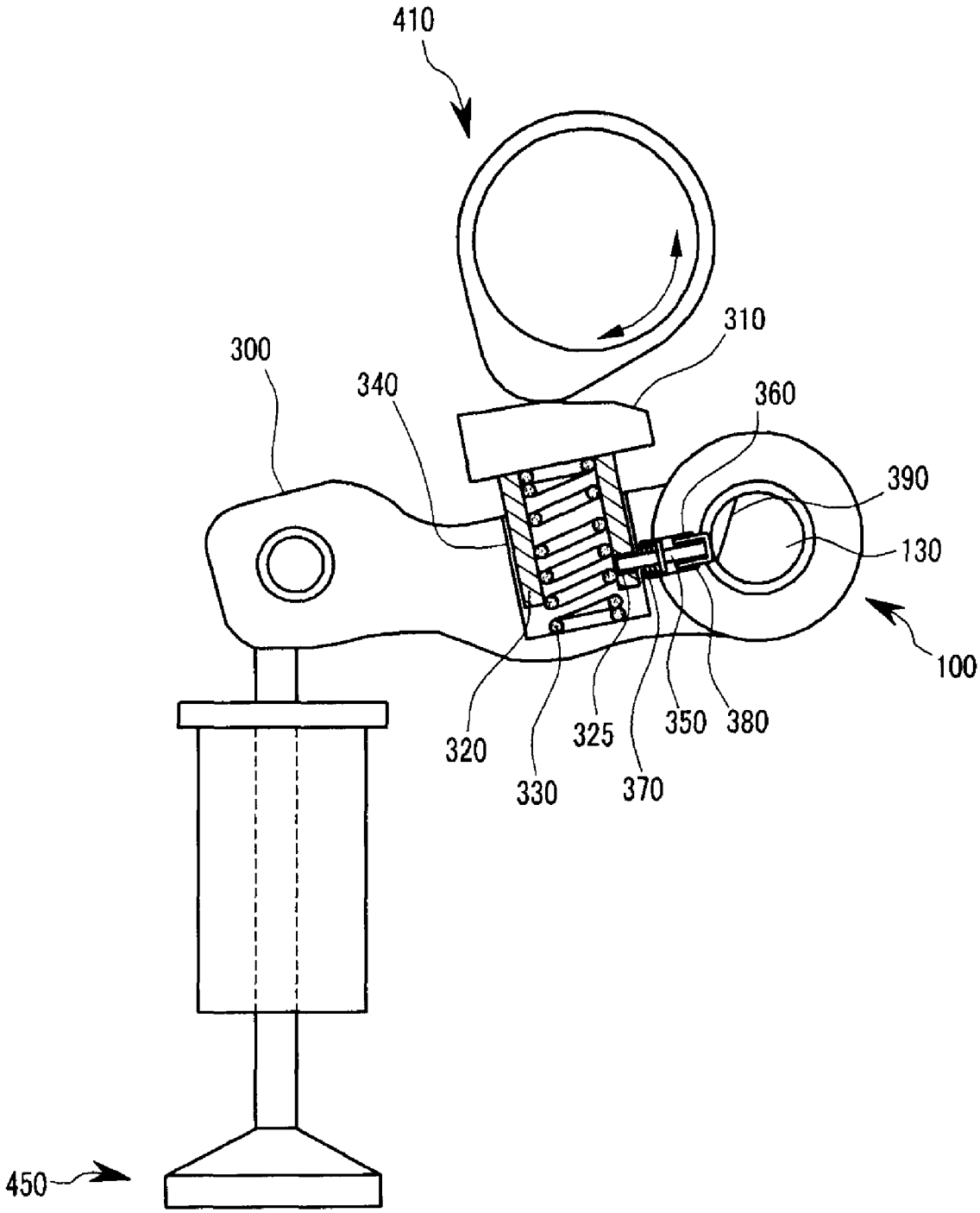
FIG. 4 is a cross-sectional view taken along line III-III of FIG. 1, showing an on state of an actuator.
Figure 5:
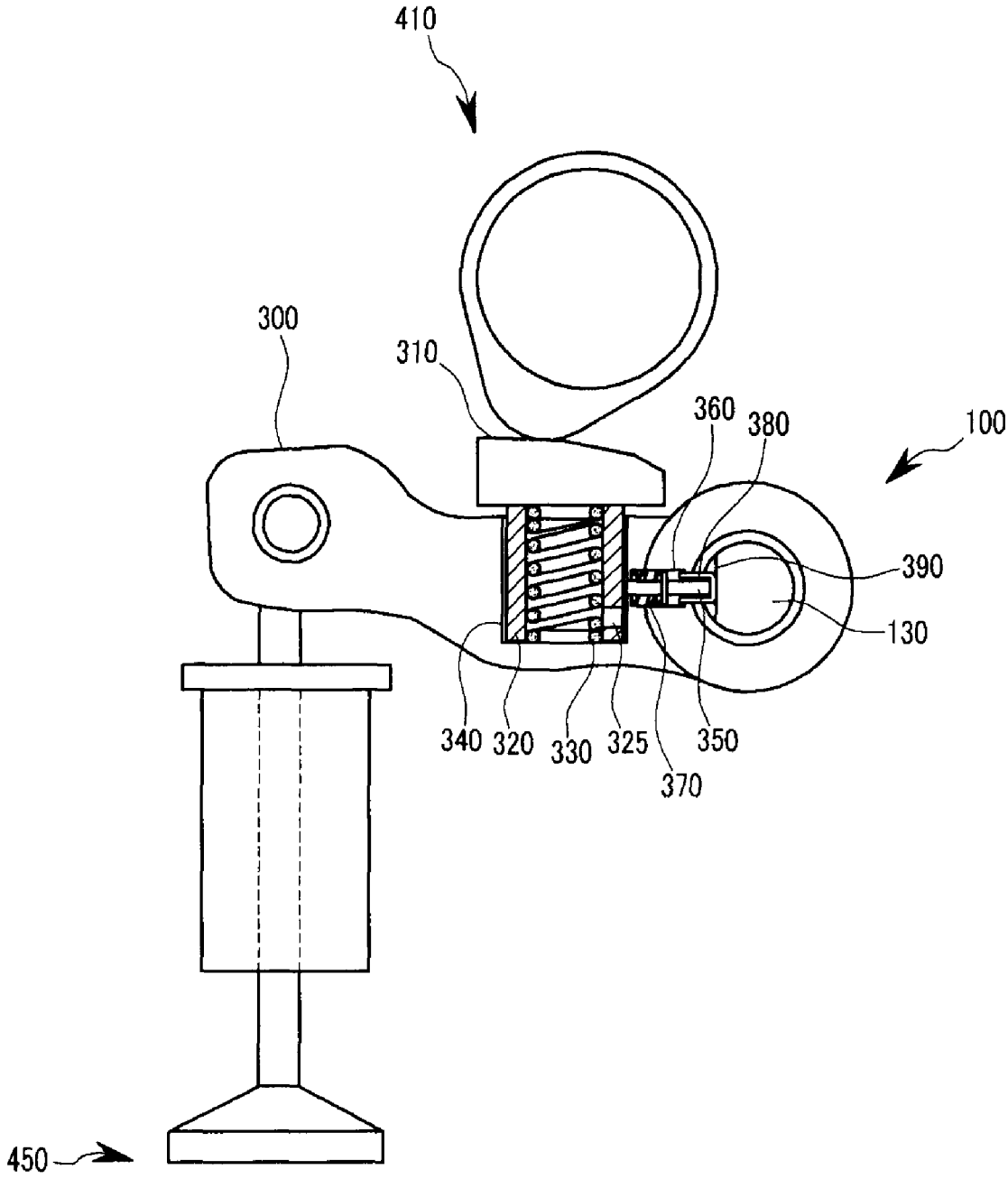
FIG. 5 is a cross-sectional view taken along line III-III of FIG. 1, showing an off state of an actuator.

FIG. 4 and FIG. 5 are views taken along line III-III of FIG. 1, showing an on state and an off state, respectively, of an actuator 120.

As shown in FIG. 1, an actuator 120 is provided on the end lever 100.

Referring also to FIGS. 4 and 5, high lift shaft 130 is disposed in the end lever 100 and rotates during operation of the actuator 120.

A high lift pin inserting portion 360 is formed in the high lift body 300, and is provided with a high lift pin 350 and a high lift pin elastic member 370 for supplying a restoring force to the high lift pin 350. A high lift assisting pin 380 (FIG. 5) may be disposed between the high lift pin 350 and the high lift shaft 130. A high lift body inserting portion 340 is formed in the high lift body 300.

As shown in FIG. 4 and FIG. 5, a rotatable high lift cam 410 is provided, and a high lift head 310 is provided for transferring the rotation of the high lift cam 410.

The high lift head 310 is supported by a high lift head supporting portion 320, which is disposed in the high lift body inserting portion 340.

The high lift body inserting portion 340 is provided with a high lift elastic member 330 for supplying a restoring force to the high lift head 310.

A high lift pin connecting portion 325 is disposed in the high lift head supporting portion 320 for connecting with the high lift pin 350.

The second hydraulic line 117 is disposed around the circumference of the high lift shaft 130 so as not to be interfered with by rotation of the high lift shaft 130.

In an off state of the hydraulic pressure adjusting valve 110, as shown in FIG. 2, the low lift pin 250 is connected with the low lift pin connecting portion 230 by the low lift pin elastic member 260 when hydraulic pressure is not supplied. Then, the low lift body 200 opens and closes the valve 450 by rotation of the low lift cam 400.

In an on state of the hydraulic pressure adjusting valve 110, as shown in FIG. 3, hydraulic pressure is supplied to the low lift pin inserting portion 240 via the first, second, and third hydraulic lines 115, 117, and 270 sequentially. The low lift pin 250 and the low lift pin connecting portion 230 are separated by the hydraulic pressure.

Lost motion of the low lift body 200 occurs despite rotation of the low lift cam 400 because the low lift pin 250 and the low lift pin connecting portion 230 are not in contact. If the range of this lost motion is adjusted, the open and close amount of the valve is correspondingly adjusted and a cylinder deactivation (CDA) state can be realized.

Operation of the high lift body will be described. Referring to FIG. 4, the high lift shaft 130 is rotated by the actuator 120. The high lift shaft 130 is substantially circular in cross-section, with a flat edge or notch 390.

When the high lift shaft 130 rotates, i.e. when the actuator is on, the high lift shaft 130 pushes the high lift pin 350, which is connected with the high lift pin connecting portion 325. Thus, the valve 450 is opened and closed by rotation of the high lift cam 410.

The high lift assisting pin 380 is disposed between the high lift pin 350 and the high lift shaft 130, and makes the high lift pin 350 smoothly connect to the high lift pin connecting portion 325 by rotation of the high lift shaft 130.

Referring to FIG. 5, if the actuator is off, the high lift shaft 390 rotates back to its original position and the high lift pin 350 and the high lift pin connecting portion 325 are separated by the high lift pin elastic member 370.

Thus, as shown in FIG. 5, reciprocal motion of the high lift head 310 occurs when the high lift cam 410 rotates, however, the valve 450 will not be opened and closed. That is, lost motion of the high lift body 300 occurs.

If the height of the high lift head supporting portion 320 is adjusted, an opening and closing amount of the valve can be adjusted and a CDA state can be achieved.

As described above, the variable valve lift apparatus according to an exemplary embodiment of the present invention can adjust the operation height of the low lift body by adjusting the amount of lost motion of the lost motion elastic member, and can adjust the operation height of the high lift body by adjusting the height of the high lift head supporting portion.

These adjustments can be designed by a person of ordinary skill in the art based on the teachings herein.

If the operation heights of the low lift body and the high lift body are adjusted and the hydraulic pressure adjusting valve and the actuator are adjusted, the CDA mode, the low lift mode, and the high lift mode can be achieved.

That is, a first step will be attained when the high lift pin 350 and the low lift pin 250 are released, a second step will be attained when the high lift pin 350 is released and the low lift pin 250 is connected, and a third step will be attained when the low lift pin 250 is released and the high lift pin 350 is connected.

If the CDA mode is included, the CDA mode will be attained when the high lift pin 350 and the low lift pin 250 are released, a first step will be attained when the high lift pin 350 is released and the low lift pin 250 is connected, and a second step will be attained when the low lift pin 250 is released and the high lift pin 350 is connected.

For attaining the mode, amounts of valve lift of the low lift cam 400 and the high lift cam 410 are different.

A variable valve lift apparatus according to another exemplary embodiment of the present invention will hereinafter be described. Many of the components and operation of the second exemplary variable valve lift apparatus are identical to those in the first exemplary apparatus, and a description of these will not be provided here.

Figure 6:
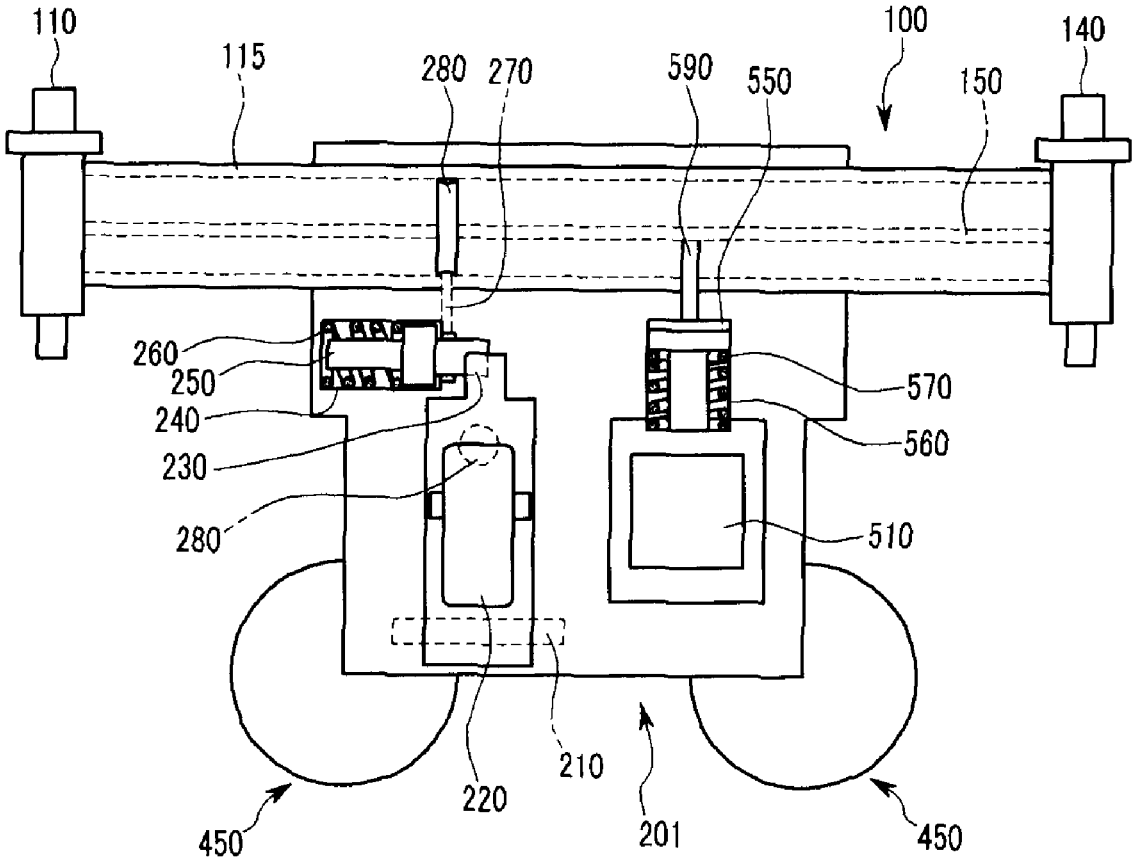
FIG. 6 is a schematic illustration of a variable valve lift apparatus according to another exemplary embodiment of the present invention.
Figure 7:
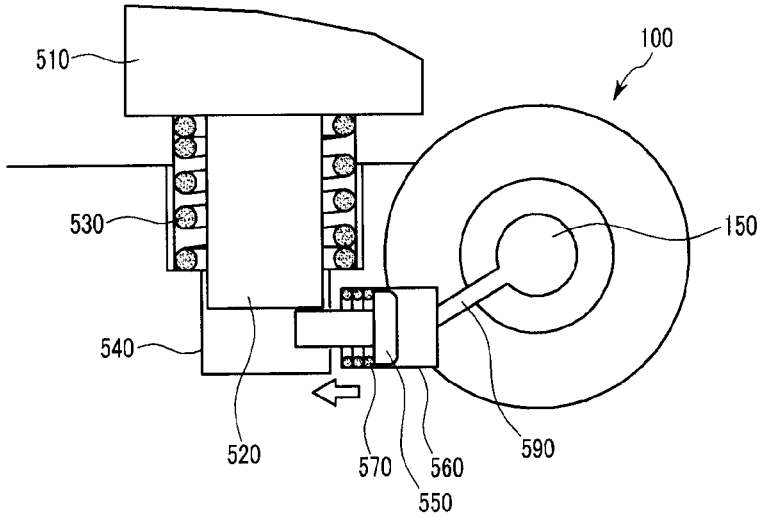
FIG. 7 is a sectional view of a high lift body of the variable valve lift apparatus according to an exemplary embodiment of the present invention.
Figure 8:
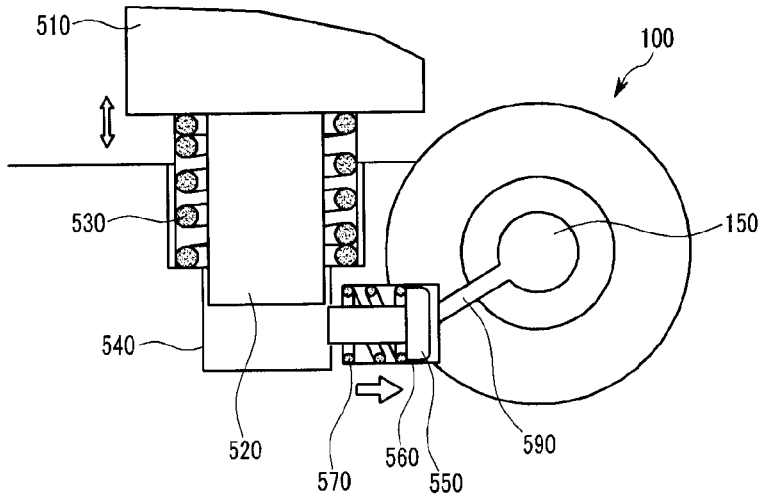
FIG. 8 is a sectional view of a high lift body of the variable valve lift apparatus according to an exemplary embodiment of the present invention when hydraulic pressure is not supplied.

Referring to FIG. 6 to FIG. 8, a high lift hydraulic pressure adjusting valve 140 is disposed in the end lever 100 for supplying hydraulic pressure.

The hydraulic pressure supplied from the high lift hydraulic pressure adjusting valve is supplied to a high lift pin inserting portion 560 via a fourth hydraulic line 150 and a fifth hydraulic line 590 formed in the end lever 100.

The high lift pin inserting portion 560 is provided with a high lift pin 550 and a high lift pin elastic member 570.

A high lift head 510 and a high lift head supporting portion 520 are disposed in a high lift body inserting portion 540 and a high lift elastic member 530 for supplying a restoring force to the high lift head 510 is disposed in the high lift body inserting portion 540.

If hydraulic pressure is supplied to the high lift pin inserting portion 560, the high lift pin 550 is inserted therein and reciprocal motion of the high lift head supporting portion 520 within the high lift body inserting portion 540 is restricted so that the valve lift apparatus operates in a conventional manner; i.e. the apparatus acts as a non-variable valve lift apparatus.

As shown in FIG. 8, if the hydraulic pressure is released, the high lift pin 550 is released by the high lift pin elastic member 570 and lost motion of the high lift head 510 and the high lift head supporting portion 520 occurs.

The high lift pin 550 and the high lift head supporting portion 520 can be connected with each other as shown in FIGS. 7 and 8 or as shown in FIGS. 4 and 5.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A variable valve lift apparatus, comprising:

an end lever;

a variable lift body connected to the end lever, and rotatable around the end lever, and comprising a high lift body and a low lift body rotatable around the high lift body;

a valve mounted on the variable lift body;

a low lift cam operable to open and close the valve; and a low lift connecting portion selectively connecting the low lift body and the high lift body;

wherein the low lift connecting portion comprises:

a hydraulic line;

a low lift pin connecting portion disposed on the low lift body;

a hydraulic pressure adjusting valve disposed on the end lever for selectively supplying hydraulic pressure to the hydraulic line; and a low lift pin selectively connected to the low lift pin connecting portion, for connecting the low lift body and the high lift body when hydraulic pressure is supplied thereto from the hydraulic line.

2. The variable valve lift apparatus of claim 1, wherein the low lift connecting portion further comprises:

a low lift pin inserting portion in the low lift body in fluid communication with the hydraulic line, the low lift pin being disposed therein; and a low lift pin elastic member disposed in the low lift pin inserting portion and supplying a restoring force to the low lift pin.

3. The variable valve lift apparatus of claim 2, wherein the hydraulic line comprises:

a first hydraulic line in the end lever, connected to the hydraulic pressure adjusting valve;

a second hydraulic line in the end lever, connected to the first hydraulic line; and a third hydraulic line in the low lift body, connected with the second hydraulic line and the low lift pin inserting portion.

4. The variable valve lift apparatus of claim 1, further comprising a lost motion elastic portion supporting and supplying a restoring force to the low lift body.

5. The variable valve lift apparatus of claim 4, further comprising a needle bearing disposed such that the low lift body reciprocates according to rotation of the low lift cam.

6. A variable valve lift apparatus, comprising:

an end lever;

a variable lift body connected to the end lever, and rotatable around the end lever, and comprising a high lift body and a low lift body rotatable around the high lift body;

a valve mounted on the variable lift body;

a low lift cam operable to open and close the valve; and a low lift connecting portion selectively connecting the low lift body and the high lift body, a high lift cam for opening and closing the valve;

a high lift head that reciprocates according to rotation of the high lift cam;

a high lift head supporting portion for supporting the high lift head;

a high lift elastic member supplying a restoring force to the high lift head; and a high lift connecting portion for selectively connecting the high lift supporting portion and the high lift body.

7. The variable valve lift apparatus of claim 6, wherein the high lift connecting portion comprises:

an actuator disposed on the end lever;

a high lift shaft that is disposed in the end lever and is selectively rotated by the actuator;

a high lift pin connecting portion in the high lift head supporting portion; and a high lift pin selectively connected to the high lift pin connecting portion by rotation of the high lift shaft.

8. The variable valve lift apparatus of claim 7, wherein the high lift shaft comprises a cross-section defined by a substantially circular arc and a substantially linear portion.

9. The variable valve lift apparatus of claim 7, wherein the high lift connecting portion further comprises:

a high lift pin inserting portion with the high lift pin disposed therein; and a high lift elastic member disposed in the high lift pin inserting portion for supplying a restoring force to the high lift pin.

10. The variable valve lift apparatus of claim 9, further comprising a high lift assisting pin disposed between the high lift shaft and the high lift pin.

11. The variable valve lift apparatus of claim 6, wherein the high lift connecting portion comprises:

a high lift hydraulic pressure adjusting valve disposed on the end lever;

a high lift hydraulic line in fluid communication with the high lift hydraulic pressure adjusting valve;

a high lift pin inserting portion disposed in the high lift body and in fluid communication with the high lift hydraulic line; and a high lift pin disposed in the high lift pin inserting portion and selectively connecting the high lift head supporting portion and the high lift body.

12. The variable valve lift apparatus of claim 11, wherein the high lift connecting portion further comprises a high lift pin elastic member that is disposed in the high lift pin inserting portion and supplies a restoring force to the high lift pin.

13. The variable valve lift apparatus of claim 6, wherein a lift amount of the low lift cam and a lift amount of the high lift cam are different.

14. The variable valve lift apparatus of claim 6, further comprising a lost motion elastic portion supporting and supplying a restoring force to the low lift body.

15. The variable valve lift apparatus of claim 14, further comprising a needle bearing disposed such that the low lift body reciprocates according to rotation of the low lift cam.

* * * * *